US008985082B2

(12) United States Patent
Griffiths et al.

(10) Patent No.: US 8,985,082 B2
(45) Date of Patent: Mar. 24, 2015

(54) ENGINE ASSEMBLY WITH PUMP CAVITY LINER AND METHOD OF ASSEMBLING AN ENGINE

(75) Inventors: Leonard Barry Griffiths, Fenton, MI (US); David R. Staley, Flushing, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 301 days.

(21) Appl. No.: 13/611,395

(22) Filed: Sep. 12, 2012

(65) Prior Publication Data

US 2014/0069356 A1 Mar. 13, 2014

(51) Int. Cl.

| | |
|---|---|
| ***F02B 77/00*** | (2006.01) |
| ***F01P 5/10*** | (2006.01) |
| *F02B 77/04* | (2006.01) |
| *F02F 7/00* | (2006.01) |

(52) U.S. Cl.

CPC . *F01P 5/10* (2013.01); *F02B 77/04* (2013.01); *F02F 2007/0075* (2013.01)

USPC ..... 123/195 C

(58) Field of Classification Search

USPC ..... 123/195 A, 195 C, 195 R, 198 E, 198 R, 123/41.44, 90.38

See application file for complete search history.

(56) References Cited

U.S. PATENT DOCUMENTS

| | | | | |
|---|---|---|---|---|
| 4,099,890 | A * | 7/1978 | Murakami et al. | 415/200 |
| 4,998,515 | A * | 3/1991 | Carvalho | 123/195 C |
| 6,247,436 | B1 * | 6/2001 | Lancefield et al. | 123/90.38 |
| 2002/0073951 | A1 * | 6/2002 | McClure | 123/195 C |
| 2003/0037754 | A1 * | 2/2003 | Neal | 123/195 C |
| 2010/0313829 | A1 * | 12/2010 | Ayukawa et al. | 123/41.44 |

FOREIGN PATENT DOCUMENTS

| | | | | |
|---|---|---|---|---|
| JP | 05033643 | A * | 2/1993 | F01P 5/12 |

* cited by examiner

*Primary Examiner* — Hung Q Nguyen

(74) *Attorney, Agent, or Firm* — Quinn Law Group, PLLC

(57) ABSTRACT

An engine assembly includes an engine cover having a pump cavity through which fluid is pumped. A liner is configured to line the pump cavity to protect the engine cover from erosion due to the pumped fluid. The engine cover can be a composite material. The liner may be a composite material as well, or, in some embodiments, can be steel or another suitable material. A method of assembling an engine includes securing a liner to an engine cover so that the liner lines a pump cavity of the engine cover to protect the engine cover from erosion at the pump cavity.

17 Claims, 4 Drawing Sheets

ENGINE ASSEMBLY WITH PUMP CAVITY LINER AND METHOD OF ASSEMBLING AN ENGINE

TECHNICAL FIELD

The present teachings generally include an engine assembly with an engine cover having a pump cavity and a method of assembling an engine.

BACKGROUND

Automotive engines are complex assemblies and must be made of materials having sufficient strength as well as the ability to withstand relatively high temperatures. Engines are typically cooled by a crankshaft-driven coolant pump mounted to the engine. Strategic use of composite components can meet engine durability requirements while decreasing overall weight.

SUMMARY

An engine assembly is provided that includes an engine cover having a pump cavity through which fluid is pumped. A liner is configured to line the pump cavity to protect the engine cover from erosion due to the pumped fluid. The liner is especially useful if the engine cover is a composite material. The liner may be a composite material as well, or in some embodiments, can be steel or another suitable material.

A method of assembling an engine includes securing a liner to an engine cover so that the liner lines a pump cavity of the engine cover to protect the engine cover from erosion at the pump cavity.

The above features and advantages and other features and advantages of the present teachings are readily apparent from the following detailed description of the best modes for carrying out the present teachings when taken in connection with the accompanying drawings.

DETAILED DESCRIPTION

Figure 1:
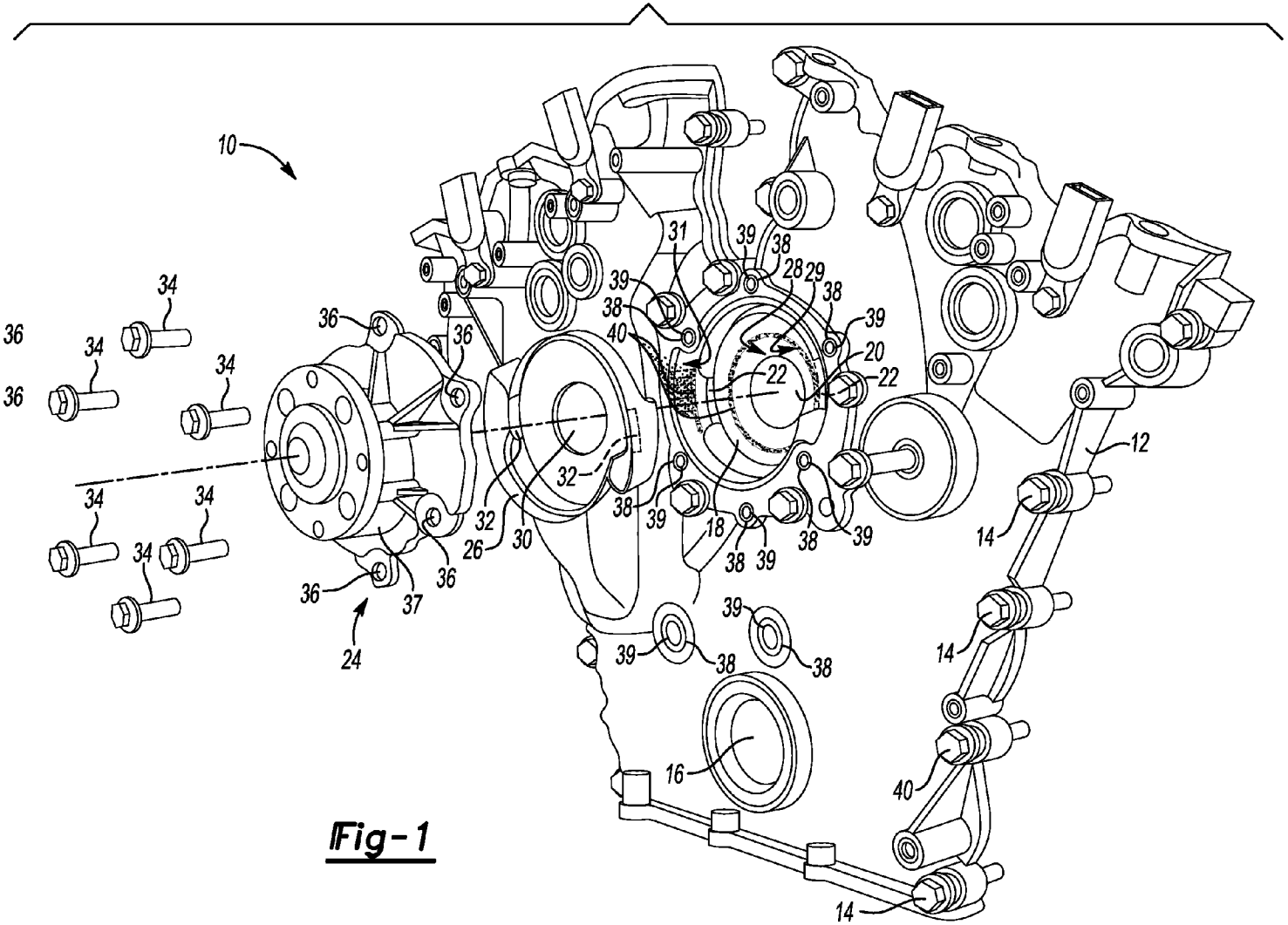
FIG. 1 is a schematic illustration in perspective exploded view of a portion of an engine assembly including an engine front cover, a pump cavity liner, and a pump assembly in accordance with a first aspect of the present teachings.

Referring to the drawings, wherein like reference numbers refer to like components throughout the several views, FIG. 1 shows an engine assembly 10 that includes a one-piece engine cover 12. The engine cover 12 is configured to be secured with a plurality of bolts 14, some of which are numbered in FIG. 1, to an engine block (not shown) on a side of the engine block. The engine cover 12 is secured to the engine block so that an engine crankshaft (not shown) can extend out of a crankshaft opening 16 formed in the engine cover 12. The engine cover 12 can be referred to as a front cover.

The engine cover 12 can be an injection-molded, one-piece component of a first composite material. As used herein, a "composite" material is a material that is a composite of a polymer and another material. For example, a "composite" may be a glass-reinforced polyamide (i.e., nylon), a glass-reinforced Acrylonitrile Butadiene Styrene (ABS), a glass-filled thermoset, a glass-filled Polybutylene Terephthalate (PBT), a glass-filled Polyethylene terephthalate (PET), or other polymer composite.

The engine cover 12 is formed with a pump cavity 18. The pump cavity 18 includes a central opening 20 through the engine cover 12 that functions as a coolant inlet. The engine cover 12 includes outlet openings 22 through which coolant is forced out by a pump assembly 24 that, when the engine assembly 10 is assembled, extends partially into the pump cavity 18. One of the outlet openings 22 is visible in FIG. 1, and the other outlet opening 22 is indicated with hidden lines.

The engine assembly 10 includes a liner 26 configured to fit within the pump cavity 18 and line substantially the entire surface 28 of the pump cavity 18. Because the pump cavity 18 is three-dimensional, the surface 28 includes both a bottom surface 29 and wall surface 31 surrounding the bottom surface 29. That is, the liner 26 is configured to be in contact with the surface 26 of the engine cover 12 at the pump cavity 18 to prevent any coolant from contacting the surface 28. The liner 26 has a central opening 30 substantially identical to the central opening 20 of the engine cover 12 to allow coolant to flow past the liner 26 to the pump assembly 24. The liner 26 also is formed with outlet openings 32 that align with the outlet openings 22 in the pump cavity 18 to allow coolant to be pumped out through the aligned openings 22, 32. The pump assembly 24 is secured to the engine cover 12 with bolts 34 that fit through openings 36 in a pump housing 37 aligned with openings 38 in the engine cover 12, each containing a threaded nut 39.

By lining the surface 28 of the pump cavity 18, the liner 26 prevents the coolant from contacting the engine cover 12 at the pump cavity 18. Because the pump assembly 24 causes relatively high speed flow of the coolant, including differential pressures within the coolant at the pump assembly 24 that create the potential for cavitation, certain materials in contact with the coolant flow could tend to erode due to the cavitation. Moreover, any particles carried in the coolant can contribute to erosion. If the coolant is an alcohol-based fluid, it can have an affinity toward certain polyamides, including certain composite materials, causing erosion.

The liner 26 can be of material with a high ability to withstand erosion from coolant flow. For example, depending on the method used to assemble the liner 26 to the engine cover 12, the liner 26 can be a metallic component, such as steel. Alternatively, the liner 26 can be a second composite component that has a greater ability to withstand erosion than the composite from which the engine cover 12 is formed. Such a second composite is likely to be more expensive than the first composite. In one embodiment, the engine cover 12 can be polyamide 6 (PA6, also referred to as nylon 6) or polyamide 66 (PA66, also referred to as nylon 6,6) and the liner can be polyamide 46 (PA46, also referred to as nylon 4,6). Because the liner 26 is much smaller in size than the composite engine cover 12, forming only the liner 26 of the more expensive second composite material can represent a cost savings compared to the alternative of forming the entire engine cover 12 from the second composite material.

The liner 26 can be secured to the engine cover 12 by use of a room temperature vulcanizing (RTV) sealant 40 inserted strategically between the engine cover 12 and the liner 26 by inserting a bead of RTV sealant 40 between the liner 26 and the engine cover 12, such as by placing a bead of sealant 40 on the engine cover 12 at the pump cavity 18, and then compressing the sealant 40 by pressing the liner 26 against the engine cover 12 until the sealant 40 is cured, thereby securing the liner 26 to the engine cover 12. As shown in FIG. 1, the sealant 40 is placed both on the bottom surface 29 and the wall surface 31 of the cavity 18. Alternatively, the sealant 40 can be placed on the outer surfaces of the liner 26 that face the surface 28 of the cavity 18, and then the liner 26 can be pressed to the engine cover 12 until the sealant 40 cures. In another embodiment, an adhesive can be used in place of the sealant 40 to secure the liner 26 to the engine cover 12.

Figure 2:
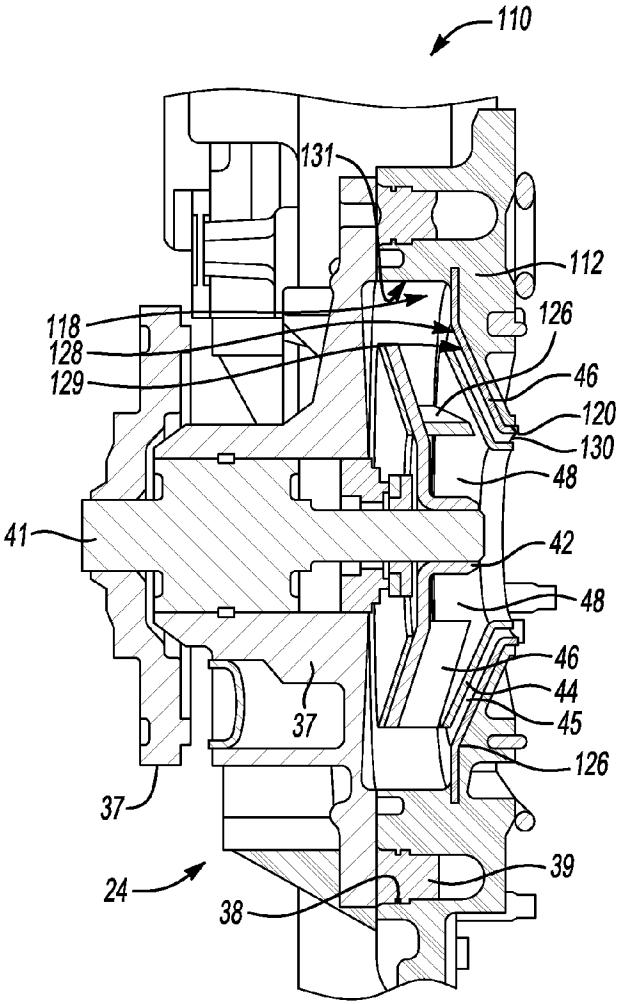
FIG. 2 is a schematic illustration in fragmentary cross-sectional view of an engine assembly including an engine front cover, a pump cavity liner co-molded with the front cover, and a pump assembly in accordance with a second aspect of the present teachings.

FIG. 2 shows an alternative embodiment of an engine assembly 110 with a composite engine cover 112, the pump assembly 24, and a liner 126. The pump assembly 24 is the same as that used in the engine assembly 10 of FIG. 1. The engine cover 112 and the liner 126 are alike in all aspects to the corresponding components engine cover 12 and liner 26 of the engine assembly 10 of FIG. 1, except that the liner 126 is co-molded with the engine cover 112. To secure the liner 126 to the engine cover 112 by co-molding the liner 126 with the engine cover 112, the liner 126 must be inserted into the injection molding die used to mold the front cover 112, and held in a correct position within the die with dowels or the like. The liner 126 can be either steel or a composite material.

The cross-sectional view of FIG. 2 illustrates the pump assembly 24 in greater detail. The pump assembly 24 includes the pump housing 37 and a drive shaft 41 extending through the pump housing 37. An impeller 42 is mounted to and is driven by the drive shaft 41. A shroud 44 is mounted to internal walls 46 of the impeller 44 to define pump passages 48 that direct fluid from the central opening 120 of the engine cover 112 and concentric central opening 130 of the co-molded liner 126 to outlet openings in the liner 126 like outlet openings 32 and aligned outlet opening in the engine cover 112 like outlet openings 22. The pump assembly 24 is bolted to the engine cover 112 with bolts 34 extending into threaded nuts 39 seated in openings 38 in the engine cover 112. The pump assembly 24 is configured so that a controlled clearance 45 exists between the shroud 44 and the liner 126. The liner 126 is shown covering only a bottom surface 129 of the entire surface 128 of the pump cavity 118 of the engine cover 112, protecting the bottom surface 129 from erosion due to current flow, but could be configured to also cover the wall surface 131 of the cavity 118.

Figure 3:
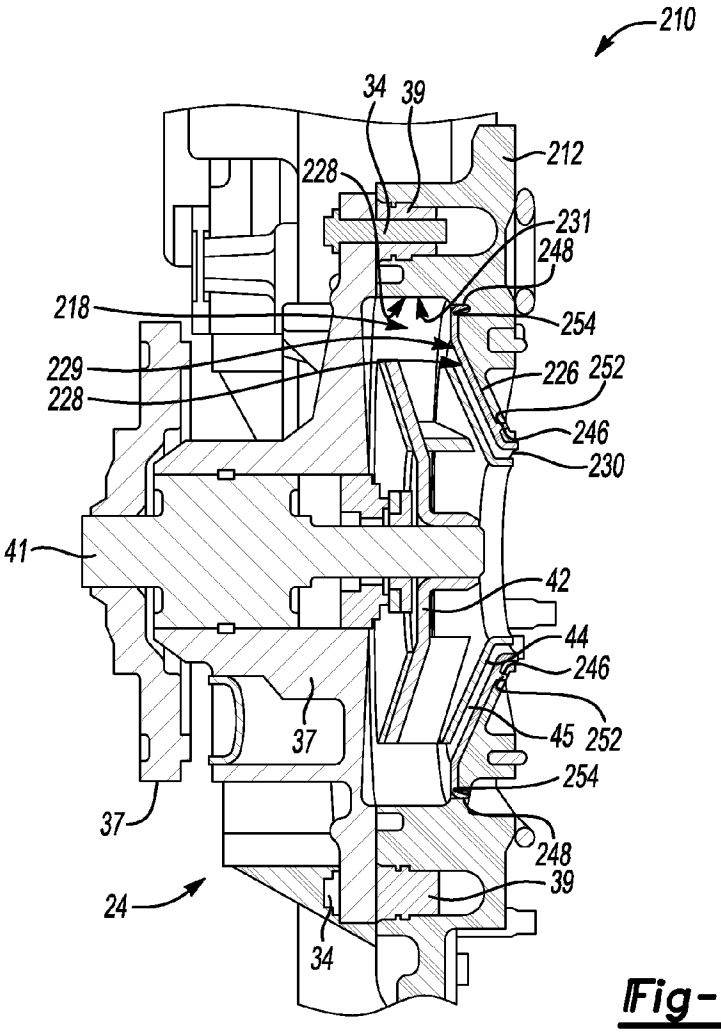
FIG. 3 is a schematic illustration in fragmentary cross-sectional view of an engine assembly including an engine front cover, a pump cavity liner vibration welded to the engine front cover, and a pump assembly in accordance with a third aspect of the present teachings.

FIG. 3 shows another embodiment of an engine assembly 210 that includes a composite engine cover 212 with a liner 226 vibration welded to the engine cover 212 at a pump cavity 218 of the engine cover 212. The pump assembly 24 extends partially into the pump cavity 218. The liner 226 is formed with tabs 246 near a center opening 230 of the liner 226 and with tabs 248 near an outer edge 250 of the liner 226. To assemble the engine assembly 210 and secure the liner 226 to the engine cover 212, the tabs 246 of the liner 226 are placed in recesses 252 of the engine cover 212. Tabs 248 of the liner 226 are placed in recesses 254 of the engine cover 212. Placing the tabs 246, 248 in the recesses 252, 254 attaches the liner 226 to the engine covers 212. The liner 226 is then secured to the engine cover 212 by vibration welding, which causes the tabs 246, 248 to melt to the engine cover 212 at the recesses 252, 254, and the liner 226 to be welded to the bottom surface 229 of the entire surface 228 of the cavity 218, protecting the bottom surface 229 from erosion due to current flow. The liner 226 could alternatively be configured to also cover the wall surfaces 231 of the cavity 18. The pump assembly 24 is then secured to the engine cover 212 with bolts 34 and nuts 39 as described with respect to engine assembly 10. The controlled clearance 45 exists between the shroud 44 and the liner 226.

Figure 4:
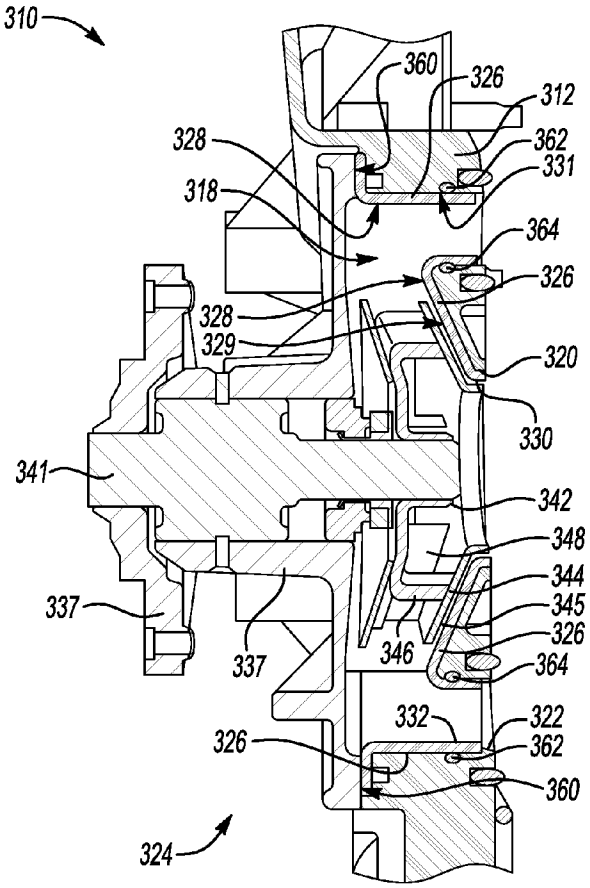
FIG. 4 is a schematic illustration in fragmentary cross-sectional view of an engine assembly including an engine front cover, and a pump cavity liner integrated with a pump assembly in accordance with a fourth aspect of the present teachings.

FIG. 4 shows another embodiment of an engine assembly 310 that includes an engine cover 312 forming a pump cavity 318. A liner 326 is integrated with a pump assembly 324 so that the liner 326 lines an entire surface 328 of the engine cover 312 at the pump cavity 318 when the pump assembly 324 is secured to the engine cover 312.

The pump assembly 324 includes a pump housing 337 and a drive shaft 341 that extends at least partially into the pump cavity 318 when the pump assembly 324 is secured to the engine cover 312. An impeller 342 is mounted to and is driven by the drive shaft 341. A shroud 344 is mounted to internal walls 346 of the impeller 342 to define pump passages 348 that direct fluid from the central opening 320 of the engine cover 312 and concentric central opening 330 of the liner 326 to outlet openings 332 in the liner 326 like openings 32 and aligned outlet openings 322 in the engine cover 312 like openings 22. The cross-sectional view in FIG. 4 is taken rotated forty-five degrees from that of the engine assembly 10 of FIGS. 2 and 3 so that the outlet openings 322 in the engine cover 312 and the outlet openings 332 in the liner 326 are visible. The liner 326 covers a bottom surface 329 of the pump cavity 318 of the engine cover 312, protecting the bottom surface 329 from erosion due to current flow. The liner 326 also covers the wall surface 331 of the cavity 318.

The liner 326 is integrated with the pump assembly 324 by attaching the liner 326 to the pump assembly 324 before the pump assembly 324 is secured to the engine cover 312. The liner 326 may be attached to the pump assembly 324 by adhering the liner 326 to a surface 360 of the pump housing 337 with adhesive placed at the surface 360, or by fastening the liner 326 to the pump housing 337 with fasteners (not shown) that extend through the housing 337 and liner 326 at openings at the surface 360. The liner 326 is configured so that a controlled clearance 345 exists between the shroud 344 and the liner 326. Once attached to the housing 337, the liner 326 and housing 337 are together moved toward the engine cover 312 so that the liner 326 contacts the engine cover 312 at the surfaces 329, 331 and lines the surfaces 329, 331. The pump housing 337 is then bolted to the engine cover 312 similarly to the way the pump housing 337 is bolted to engine cover 12 with bolts 34 and nuts 39 shown in FIG. 1, thus securing the liner 326 to the engine cover 312.

A seal 362 can be inserted in a recess in the engine cover 312 prior to inserting the liner 326 into the cavity 318 so that the seal 362 will surround the liner 326 at the wall surface 331 of the cavity 318. Another seal 364 can be inserted in a recess in the engine cover 312 prior to inserting the liner 326 into the cavity 318 so that the seal 364 surrounds the liner 326 at the bottom surface 329 of the cavity 318. Alternately, the seals 362, 364 can be secured around the liner 326 before the liner 326 is inserted into the pump cavity 318.

Figure 5:
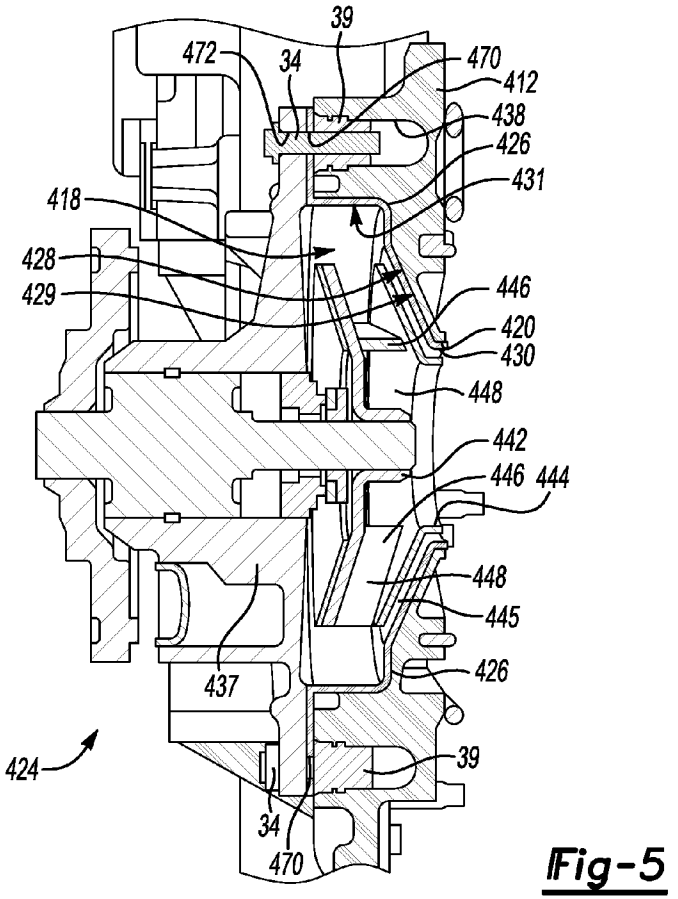
FIG. 5 is a schematic illustration in fragmentary cross-sectional view of an engine assembly including an engine front cover, a pump cavity liner mechanically retained between a pump assembly and the engine front cover in accordance with a fifth aspect of the present teachings.

FIG. 5 shows another embodiment of an engine assembly 410 that includes an engine cover 412 forming a pump cavity 418. A pump assembly 424 includes a pump housing 437 and a drive shaft 441 that extends at least partially into the pump cavity 418 when the pump assembly 424 is secured to the engine cover 412. An impeller 442 is mounted to and is driven by the drive shaft 441. A shroud 444 is mounted to internal walls 446 of the impeller 442 to define pump passages 448 that direct fluid from the central opening 420 of the engine cover 412 and concentric central opening 430 of the liner 426 to outlet openings in the liner 426 like openings 32 and aligned outlet openings in the engine cover 412 like openings 22. The liner 426 covers an entire surface 428 of the engine cover 412 at the cavity 418, including a bottom surface 429 of the pump cavity 418 of the engine cover 412, and a wall surface 431 of the cavity 418, thereby protecting the entire surface 428 from erosion due to current flow.

The liner 426 is mechanically retained between the pump assembly 424 and the engine cover 412 so that the liner 426 lines the entire surface 428 of the engine cover 412 at the pump cavity 418 when the pump assembly 424 is secured to the engine cover 412. As used herein, "mechanically retained" means retained with fasteners, such as the bolts 34 and nuts 39 as described with respect to the engine assembly 10 of FIG. 1. The liner 426 is configured so that a controlled clearance 445 exists between the shroud 444 and the liner 426. In the engine assembly 410, the liner 426 also has openings 470 that align with the openings 472 in the pump housing 437 and the threaded nuts 39 held in the openings 438 of the engine cover 412. In an alternative embodiment, fasteners can be used to fasten the liner to the engine cover 412 that are separate from fasteners used to fasten the pump housing 424 to the engine cover 412.

Figure 6:
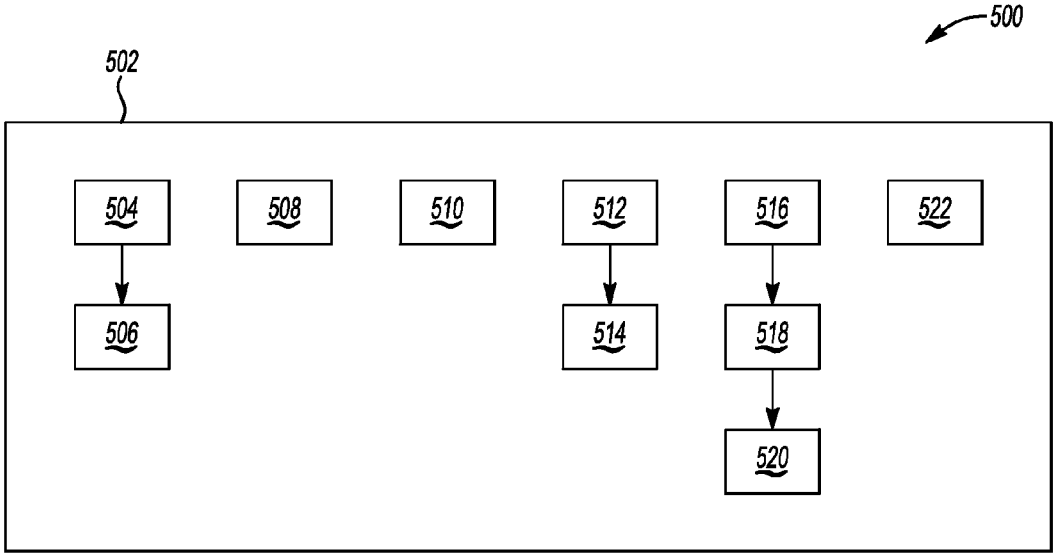
FIG. 6 is a flowchart of a method of assembling an engine.

Assembly of the engine assemblies 10, 110, 210, 310, 410 of FIGS. 1-5 thus involves various methods of securing a liner to an engine cover to line a pump cavity of the engine cover. Referring to FIG. 6, a flowchart shows a method 500 of assembling an engine. The method 500 is described with respect to each of the embodiments of FIGS. 1-5, and includes step 502, securing a liner to an engine cover so that the liner lines a pump cavity of the engine cover to protect the engine cover from erosion at the pump cavity.

In the embodiment of FIG. 1, the securing step 502 includes sub step 504, inserting a room temperature vulcanizing (RTV) sealant 40 between the liner 26 and the engine cover 12, such as on the surface 28 of the engine cover 12 at the pump cavity 18. The securing step 502 then includes sub step 506, compressing the sealant 40 by pressing the liner 26 against the engine cover 12 until the sealant 40 is cured, thereby securing the liner 26 to the engine cover 12. Alternatively, in the embodiment of FIG. 1, the securing step 502 can be by sub step 508, adhering the liner 26 to the engine cover 12.

In the embodiment of FIG. 2, the securing step 502 includes sub step 510, co-molding the liner 126 with the engine cover 112. As discussed with respect to FIG. 2, the liner 126 may be either a composite material, steel, or other material, and must be positioned within the injection mold used to form the engine cover 112.

In the embodiment of FIG. 3, the securing step 502 includes sub step 512, attaching the liner 226 to the engine cover 212 at the pump cavity 218 by inserting tabs 246, 248 of the liner 212 into recesses 252, 254 formed in the engine cover 212. Step 502 then includes sub step 514, vibration welding the liner 226 to the engine cover 212 sufficiently to melt the tabs 252, 254 to the engine cover 212, securing the liner 226 to the engine cover 212.

In the embodiment of FIG. 4, the liner 326 is integrated with the pump assembly 324. Accordingly, the securing step 502 includes sub step 516, connecting the liner 326 to a pump assembly 324, followed by sub step 518, inserting the pump assembly 324 into the cavity 318 so that the liner 326 lines the cavity 318. The securing step 502 may also include sub step 520, surrounding the liner 326 with a sealing component 362 and/or 364 to prevent any fluid from contacting the engine cover 312 at the cavity 318.

In the embodiment of FIG. 5, the liner 426 is mechanically retained between the engine cover 412 and the pump housing 437. Accordingly, the securing step 502 includes sub step 522, fastening the liner 426 to the engine cover 412 and to a pump housing 437 of a pump assembly 424 placed in the pump cavity 418 so that the liner 426 is between the engine cover 412 and the pump assembly 424 and lines the surface 428 of the engine cover 412 at the cavity 418.

While the best modes for carrying out the many aspects of the present teachings have been described in detail, those familiar with the art to which these teachings relate will recognize various alternative aspects for practicing the present teachings that are within the scope of the appended claims.

The invention claimed is:

1. An engine assembly comprising:

an engine cover having a pump cavity through which fluid is pumped; and a liner configured to line the pump cavity to protect the engine cover from erosion due to the pumped fluid.

2. The engine assembly of claim 1, wherein the cover is a composite material.

3. The engine assembly of claim 1, wherein the liner is co-molded into the engine cover.

4. The engine assembly of claim 1, wherein the liner has tabs configured to melt to the engine cover during vibration welding to secure the liner to the engine cover.

5. The engine assembly of claim 1, further comprising:

a pump assembly with a pump housing and a shroud operatively connected to the pump housing; wherein the liner is integrally connected to the pump housing and the shroud with a controlled clearance between the liner and the shroud; and wherein the liner is configured to line the pump cavity when the pump housing is fit to the engine cover; and a sealing component around the liner between the liner and the engine cover.

6. The engine assembly of claim 1, further comprising:

a pump assembly with a pump housing and a shroud operatively connected to the pump housing; and wherein the liner is fastened to the pump housing and the engine cover so that the liner is between the engine cover and the shroud.

7. An engine assembly comprising:

an engine cover of a first composite material; wherein the engine cover has a pump cavity;

a pump assembly secured to the engine cover and at least partially disposed within the pump cavity; wherein the pump assembly is configured to pump fluid through the pump cavity;

a liner configured to line the pump cavity by covering at least a portion of of a surface of the cover at the pump cavity; and wherein the liner is of a second composite material configured to prevent erosion of the cover.

8. The engine assembly of claim 7, wherein the liner has tabs configured to melt to the engine cover during vibration welding to secure the liner to the engine cover.

9. The engine assembly of claim 7, wherein the pump assembly has a pump housing and a shroud operatively connected to the pump housing; wherein the liner is integrally connected to the pump housing and the shroud with a controlled clearance between the liner and the shroud;

wherein the liner is configured to line the cavity when the pump housing is fit to the engine cover; and a sealing component around the liner between the liner and the engine cover.

10. The engine assembly of claim 7, wherein the pump assembly has a pump housing and a shroud operatively connected to the pump housing; and wherein the liner is fastened to the pump housing and the engine cover so that the liner is between the engine cover and the shroud.

11. A method of assembling an engine comprising:

securing a liner to an engine cover so that the liner lines a pump cavity of the engine cover to protect the engine cover from erosion at the pump cavity.

12. The method of claim 11, wherein said securing is by co-molding the liner with the engine cover.

13. The method of claim 11, wherein said securing includes:

attaching the liner to the engine cover at the pump cavity by inserting tabs of the liner into recesses formed in the engine cover; and vibration welding the liner to the engine cover sufficiently to melt the tabs to the engine cover.

14. The method of claim 11, wherein said securing includes:

inserting a room temperature vulcanizing (RTV) sealant between the liner and the engine cover; and compressing the RTV sealant between the liner and the engine cover.

15. The method of claim 11, wherein said securing is by adhering the liner to the engine cover.

16. The method of claim 11, wherein said securing includes:

connecting the liner to a pump assembly;

inserting the pump assembly into the cavity so that the liner lines the cavity; and surrounding the liner with a sealing component.

17. The method of claim 11, wherein said securing includes:

fastening the liner to the engine cover and to a pump housing of a pump assembly extending into the cavity so that the liner is between the pump housing and a shroud of the pump assembly engine cover.

* * * * *